US006966381B2

(12) United States Patent
Stjernstrom et al.

(10) Patent No.: US 6,966,381 B2
(45) Date of Patent: Nov. 22, 2005

(54) DRILL-THROUGH SPOOL BODY SLEEVE ASSEMBLY

(75) Inventors: Scott Stjernstrom, Bellaire, TX (US); Michael Matusek, Houston, TX (US); David H. Theiss, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 184 days.

(21) Appl. No.: 10/409,872

(22) Filed: Apr. 9, 2003

(65) Prior Publication Data

US 2004/0200614 A1 Oct. 14, 2004

(51) Int. Cl.[7] ..... E21B 44/00

(52) U.S. Cl. ..... 166/337; 166/250.08; 166/85.3; 166/88.1

(58) Field of Search ..... 166/337, 250.08, 166/379, 85.3, 88.1

(56) References Cited

U.S. PATENT DOCUMENTS

| | | | | |
|---|---|---|---|---|
| 3,295,600 | A | 1/1967 | Brown et al. | 166/5 |
| 4,154,302 | A | 5/1979 | Cugini | 166/315 |
| 5,143,158 | A | 9/1992 | Watkins et al. | 166/344 |
| 5,544,707 | A | 8/1996 | Hopper et al. | 166/382 |
| 5,575,336 | A | 11/1996 | Morgan | 166/330 |
| 5,941,310 | A | 8/1999 | Cunningham et al. | 166/345 |
| 5,975,210 | A | 11/1999 | Wilkins et al. | 166/341 |
| 6,003,602 | A | 12/1999 | Wilkins | 166/339 |
| 6,039,119 | A | 3/2000 | Hopper et al. | 166/368 |
| 6,227,300 | B1 | 5/2001 | Cunningham et al. | 166/339 |
| 6,293,345 | B1 | 9/2001 | Watkins | 166/368 |
| 6,302,212 | B1 | 10/2001 | Nobileau | 166/368 |
| 6,360,822 | B1 | 3/2002 | Robertson | 166/368 |
| 6,453,944 | B2 | 9/2002 | Bartlett | 137/601.01 |
| 6,470,968 | B1 | 10/2002 | Turner | 166/348 |
| 6,516,861 | B2 | 2/2003 | Allen | 161/351 |
| 2003/0051878 | A1 * | 3/2003 | DeBerry | 166/348 |
| 2003/0192698 | A1 * | 10/2003 | Dallas | 166/307 |

FOREIGN PATENT DOCUMENTS

| | | | |
|---|---|---|---|
| WO | WO 92/00438 | 1/1992 | E21B 33/076 |

(Continued)

OTHER PUBLICATIONS

SPE 23145; *Installation of Concentric Subsea Completions from a Jack-Up in the Welland Field: A Case History*; Sep. 3-6, 1991; R.O. Sanders (pp. 405-415) (15 sheets drawings).

(Continued)

*Primary Examiner*—William Neuder
(74) *Attorney, Agent, or Firm*—Conley Rose, P.C.

(57) ABSTRACT

A drill-through spool body sleeve assembly comprises a test sleeve removably installed within a drill-through spool body having a bore with the terminal ends of the outer diameter of the test sleeve sealingly engaging the bore wall. The sleeve assembly also comprises a wear bushing removably installed in the bore between the bore wall and the test sleeve. The test sleeve is of sufficient thickness to pressure test the spool body outlets, ports, and valves before drilling and production. The test sleeve seals the bore from the outside of the spool body during the pressure testing. After the pressure tests are completed, the test sleeve is removed from the spool body, leaving the wear bushing in place. The wear bushing protects the bore wall, outlets, ports, and valves while allowing equipment such as drilling and well-head equipment to pass through the spool body. After the well is drilled and the casing strings are installed, the wear bushing is removed from the spool body to allow the installation of the production tubing and production hanger within the spool body.

88 Claims, 9 Drawing Sheets

FOREIGN PATENT DOCUMENTS

| | | | |
|---|---|---|---|
| WO | WO 99/18329 | 4/1999 | ..... E21B 33/035 |
| WO | WO 00/47864 | 8/2000 | ..... E21B 33/035 |
| WO | WO 01/73254 | 10/2001 | ..... E21B 33/035 |
| WO | WO 01/73256 | 10/2001 | ..... E21B 33/04 |
| WO | WO 01/73257 | 10/2001 | ..... E21B 33/043 |
| WO | WO 01/73259 | 10/2001 | ..... E21B 34/04 |
| WO | WO 01/73260 | 10/2001 | ..... E21B 34/04 |

OTHER PUBLICATIONS

Cooper Oil Tool; *Phillips Petroleum Company Ann Subsea Facility*; TMH 04445; Nov. 1991; (pp. CCH 36064-36223).

* cited by examiner

DRILL-THROUGH SPOOL BODY SLEEVE ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates in general to well drilling and production equipment, and in particular to a drill-through spool body sleeve assembly for testing the spool body transverse bores and valves and for protecting the spool body during drilling operations.

2. Description of the Related Art

A well capable of producing oil or gas will have a conductor housing secured to a string of conductor pipe, the conductor pipe extending a short depth into the well. A wellhead housing then is landed in the conductor housing. The wellhead housing is secured to an outer or first string of casing. The first string of casing extends through the conductor to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is cased to its final depth. Each string of casing is supported at the upper end by a casing hanger. The casing hanger lands in and is supported by the wellhead housing.

In typical wells, multiple strings of casing are suspended within the wellhead housing to achieve structural support for the well to the depth of the target zone. Where multiple strings of casing are set within the outer casing, multiple casing hangers are landed in the wellhead housing, each set above the previous one in the wellhead housing. Between each casing hanger and the wellhead housing, a casing hanger seal assembly is set to isolate each annular space between strings of casing. The last, and innermost, string of casing extends into the well to the final depth, this being the production casing. The strings of casing between the outer casing and the production casing are typically referred to as intermediate casing strings.

When drilling and running strings of casing in the well, it is critical that the operator maintain pressure control of the well. This is accomplished by establishing a column of fluid with predetermined fluid density inside the well. During drilling operations, this fluid is circulated down into the well through the inside of the drill string out the lower terminal end of the drill string and back up the annulus around the drill string to the surface. This column of density-controlled fluid balances the downhole pressure in the well. When setting casing, the casing is run into the pressure balanced well and then cemented in place.

A blowout preventer system (BOP) is employed during drilling and running strings of casing in the well as another safety system to ensure that the operator maintains pressure control of the well. The BOP is located above the wellhead housing by running it on a drilling riser to the wellhead housing.

After drilling and installing the casing strings is complete, the well must be completed for production. In the well, the production fluids flow through perforations made in the production casing at the producing zone. A string of production tubing extends to the producing zone within the production casing to provide a pressure-controlled conduit through which the well fluids are produced. At some point above the producing zone, a packer seals the space between the production casing and the production tubing to ensure that the well fluids flow through the production tubing to the surface. The tubing is supported by a tubing hanger assembly that lands and locks above the production casing hanger.

At the wellhead, various arrangements of production control valves are arranged in an assembly generally known as a tree. In some wells, a vertical tree is installed on the wellhead housing. First, the production hanger and production tubing are installed in the wellhead housing. Then, the BOP is removed and then the vertical tree is locked and sealed onto the wellhead housing. The vertical tree has one or more production bores containing actuated valves and extending vertically to respective lateral production fluid outlets in the wall of the vertical tree. The production bores and production valves are in-line with the production tubing. An example of a vertical tree would include a monobore vertical tree.

Using vertical trees involves problems, however. If it is necessary to pull the completion, consisting essentially of the tubing string and tubing hanger, the vertical tree needs to be removed and replaced by the BOP. However, replacing the BOP involves setting and testing plugs or relying on downhole valves, which may be unreliable by not having been used or tested for a long time. The well is also in a vulnerable condition while the vertical tree and BOP are being exchanged and neither one is in position, which is a lengthy operation. This usually involves plugging and/or killing the well.

In addition, installing the production hanger and production tubing in the wellhead housing can involve problems. For example, the wellhead housing seal bore in the area where the production hanger lands could be damaged. A damaged wellhead housing could cause significant problems because wellhead housings are not able to be retrieved once installed. Also, the wellhead housing may not be compatible for connection with the vertical tree. In addition, the wellhead may have been installed at an undesirable elevation. Also, the wellhead may not have sufficient room for a tubing hanger due to the number of casing hangers installed in the wellhead.

To alleviate some of the problems associated with installing the production hanger and production tubing in the wellhead housing, a spool body may be installed between the vertical tree and the wellhead housing. With a spool body, the production hanger and production tubing are installed in the spool body instead of the wellhead housing.

One example of a spool body is a tubing spool. The tubing spool provides an undamaged bore in which the production hanger and tubing may be installed. It may also act as an adapter with its lower terminal end compatible with the wellhead housing and its upper terminal end compatible with the lower terminal end of the vertical tree. It can also locate the tree at a more desirable elevation. A tubing spool also can provide a position for the tubing hanger in the event there is none in the wellhead housing. When drilling the well, the tubing spool is installed after the production casing has been installed in the wellhead. This requires that the BOP must first be removed from the wellhead before installing the tubing spool. After the tubing spool is installed, the BOP is then installed onto the tubing spool. After, the production hanger and production tubing is installed in the tubing spool, the BOP is removed and the vertical tree is installed onto the tubing spool.

Thus, the tubing spool, while alleviating some of the problems associated with using a vertical tree alone, still leaves the well in a vulnerable condition while the tubing spool and BOP are being exchanged and neither one is in position. Also, if it is necessary to pull the completion, consisting essentially of the tubing string and tubing hanger, the vertical tree needs to be removed and replaced by the BOP.

Another example of a tubing spool is a drill-through tubing spool, which is a type of drill-through spool body. The drill-through tubing spool is installed on the wellhead housing at the point when a BOP is needed for drilling. The drill-through tubing spool has a large through bore capable of passing equipment through the tubing spool bore. Thus, the drill-through tubing spool provides the additional benefit of eliminating the need to make multiple BOP trips.

However, the drill-through tubing spool also presents problems to the drilling and completion operations. The drill-through tubing spool includes transverse bores with respective valves that all need to be pressure tested not only at production operation pressures, but also drilling operation pressures. The pressure tests can be performed before and/or after the drill-through tubing spool is installed on the wellhead housing. To perform the pressure tests, a bore protector sleeve is typically installed in the tubing spool through bore. The bore protector sleeve must be of sufficient thickness to be strong enough to withstand the test pressures without deforming.

The drill-through tubing spool through bore must also be protected as the equipment is run through the tubing spool prior to installing the tubing hanger. To protect the drill-through tubing spool bore wall, a bore protector sleeve may be inserted. A bore protector sleeve is also used to protect the drill-through tubing spool bore wall while the drilling string, casing strings, and casing hangers pass through the drill-through tubing spool. After the drilling operations are completed, the bore protector sleeve is pulled out of the drill-through tubing spool before the production tubing and tubing hanger are installed.

Although bore protector sleeves may be used for pressure testing and also protecting the tubing spool, the bore protector sleeve must have a large enough inner diameter to allow equipment to pass through the protector sleeve bore. In addition, the bore protector sleeve must have a small enough outer diameter to be retrieved from the drill-through tubing spool without removing the BOP. In addition, in the case of an offshore well, the bore protector sleeve must small enough to be retrieved through a drilling riser connecting the well to the water surface.

A drill-through tubing spool bore protector sleeve of sufficient size to withstand the pressure testing is too thick to allow the passage of equipment during drilling operations. One solution is to install a testing bore protector inside the drill-through tubing spool for pressure testing the drill-through tubing spool. After the testing is complete, the testing bore protector is removed from the drill-through tubing spool. Then, a drilling bore protector sleeve of a larger inner diameter is inserted into the drill-through tubing spool through bore to protect the tubing spool through bore during the drilling operations. The drilling bore protector sleeve is retrieved before the production tubing and production hanger are installed in the drill-through tubing spool. Thus, three "trips" are necessary, a first trip to remove the testing bore protector sleeve from the drill-through tubing spool, a second trip to install the drilling bore protector sleeve, and a third trip to remove the drilling bore protector sleeve.

Instead of using vertical trees, trees with the arrangement of production control valves offset from the production tubing, generally called horizontal trees, can be used. One type of horizontal tree is a Spool Tree™ shown and described in U.S. Pat. No. 5,544,707, hereby incorporated herein by reference. A horizontal tree also locks and seals onto the wellhead housing. In horizontal trees, however, the tubing hanger locks and seals in the tree bore. With the production valves offset from the production tubing, the production tubing hanger and production tubing may be removed from the tree without having to remove the horizontal tree from the wellhead housing. Horizontal trees have a larger through bore than a vertical tree and can thus allow the passage of larger equipment than vertical trees. A problem with horizontal trees, however, is that they are installed after the production casing has been installed in the wellhead. Therefore, horizontal trees require that the BOP must first be removed from the wellhead before installing the horizontal tree. After the horizontal tree is installed, the BOP is then installed onto the horizontal tree, thus requiring two "trips" to install the horizontal tree and the BOP.

The transverse bores of the horizontal tree, such as the production outlets and ports, as well as the transverse bore valves, need to be pressure tested at production operation pressures before producing well bore fluids. The pressure tests can be performed before and/or after the tree is installed on the wellhead housing. If the pressure tests are performed after installation on the wellhead housing, a means of preventing pressure from being applied downhole must be employed.

To perform the pressure tests, a bore protector sleeve is typically installed in the tree through bore. The bore protector sleeve must be of sufficient thickness to be strong enough to withstand the test pressures without deforming. In addition, the bore protector sleeve protects the tree through bore wall from equipment as it passes through the horizontal tree.

Another example of a horizontal tree is a drill-through horizontal tree. Drill-through horizontal trees also lock and seal on the wellhead housing, with the BOP landed on the drill-through horizontal tree. The production tubing hanger assembly locks and seals in the drill-through horizontal tree instead of in the wellhead housing. The drill-through horizontal tree has a large through bore for allowing equipment to pass through the tree bore. The large horizontal drill-through tree bore also allows the production tubing string to be pulled out through the BOP without disturbing the drill-through tree and the pressure integrity of the well. With a drill-through tree, the tree can be installed on the wellhead housing at the point when a BOP is needed for drilling. The problems associated with the vertical tree and the regular horizontal tree are solved with the drill-through tree because the well may be drilled and completed without pulling the BOP off the well for completing the well. Therefore, the well is always secure and only one BOP "trip" is necessary to drill and complete the well. Thus, the horizontal drill-through tree is also another type of drill-through spool body, with the addition of housing the production ports and valves.

However, the drill-through horizontal tree also presents problems to the drilling and completion operations. As with the regular horizontal tree, the transverse bores and respective valves of the drill-through tree need to be pressure tested. However, the pressure tests need to be run not only at production operation pressures, but also drilling operation pressures, before drilling the well and producing well bore fluids. The pressure tests can be performed before and/or after the tree is installed on the wellhead housing. To perform the pressure tests, a bore protector sleeve is also typically installed in the tree through bore. The bore protector sleeve must be of sufficient thickness to be strong enough to withstand the test pressures without deforming.

As with the regular horizontal tree, the drill-through tree through bore must also be protected as the equipment is run through the tree prior to installing the tubing hanger. A bore protector sleeve is also used to protect the drill-through tree bore wall while the drilling string, casing strings, and casing hangers pass through the drill-through tree. After the drilling operations are completed, the bore protector sleeve is pulled out of the drill-through tree before the production tubing and tubing hanger are installed.

Although bore protector sleeves may be used for pressure testing the tree and for protecting the tree, the bore protector sleeve must have a large enough inner diameter to allow equipment to pass through the drill-through tree through bore. In addition, the bore protector sleeve must have a small enough outer diameter to be retrieved from the drill-through tree without removing the BOP. In addition, in the case of an offshore well, the bore protector sleeve must be small enough to be retrieved through a drilling riser connecting the well to the water surface.

A drill-through tree bore protector of sufficient size to withstand the pressure testing is too thick to allow the passage of equipment during drilling operations. One solution is to install a testing bore protector inside the drill-through tree for pressure testing the drill-through tree. After the testing is complete, the testing bore protector is removed from the drill-through tree. Then, a drilling bore protector sleeve of a larger inner diameter is inserted into the drill-through tree through bore to protect the tree through bore during the drilling operations. The drilling bore protector sleeve is retrieved before the production tubing and production hanger are installed in the drill-through horizontal tree. Thus, three "trips" are necessary, a first trip to remove the testing bore protector sleeve from the drill-through tree, a second trip to install the drilling bore protector sleeve, and a third trip to remove the drilling bore protector sleeve.

In drilling a well, especially an offshore well, additional time can significantly raise the cost of drilling a well. To lower cost, some wells are drilled with only with the drilling bore protector installed. Installing the drill-through tree with only a drilling bore protector, however, sacrifices the ability to properly pressure test the drill-through tree transverse bores and valves such as with a test bore protector.

It is desired to properly test the drill-through tree connections, ports, and valves and also protect the tree through bore in a time and cost efficient manner. Consequently, to effectively test the drill-through tree transverse bores and valves and protect the tree through bore, the present invention has been developed. Other objects and advantages of the invention will appear from the following description.

SUMMARY OF THE EMBODIMENTS

The drill-through spool body sleeve assembly installs in the bore of a drill-through spool body. The sleeve assembly comprises a test sleeve removably installed within the drill-through spool body bore. The sleeve assembly also comprises a wear bushing removably installed in the drill-through spool body bore between the bore wall and the outside of the test sleeve. The test sleeve sealingly engages the drill-through spool body bore wall on both ends of the wear bushing. The test sleeve is of sufficient thickness to pressure test the transverse bores and valves of the drill-through spool body. The test sleeve also seals the inside of the drill-through spool body bore during the pressure tests.

After the pressure tests are completed, the test sleeve is removed from the drill-through spool body bore, leaving the wear bushing in place. The wear bushing protects the drill-through spool body bore wall, transverse bores, valves, hydraulic connections, and electrical connections while allowing the equipment to pass through the drill-through spool body bore.

After the well is drilled and the casing strings are installed, the wear bushing is removed from the drill-through spool body to allow completion of the well by installing the production tubing and production hanger. After completing the well, the well may be produced by flowing well fluids through the drill-through spool body.

If additional downhole work is needed, the production tubing and hanger may be removed from the drill-through spool body and the wear bushing reinstalled. After protecting the drill-through spool body bore during the additional downhole work, the wear bushing is again removed and the production tubing and production hanger are reinstalled for additional well fluid production.

In another embodiment, the test sleeve does not sealingly engage the drill-through spool body bore wall on both ends of the wear bushing. Instead, at least one terminal end of the wear bushing sealingly engages the drill-through spool body bore wall to seal off the inside of the drill-through spool body bore. In addition, both terminal ends of the wear bushing may sealingly engage the bore wall with the terminal ends of the test sleeve sealingly engaging the wear bushing. If only one terminal end of the wear bushing sealingly engages the bore wall, one terminal end of the test sleeve sealingly engages the same wear bushing terminal end while the other terminal end of the test sleeve sealingly engages the bore wall. If both terminal ends of the wear bushing sealingly engage the bore wall, then both terminal ends of the test sleeve sealingly engage the wear bushing.

Both embodiments may be used in any drill-through spool body. For example, the embodiments may be installed in a drill-through horizontal tree installed between a wellhead housing and a BOP. The embodiments may also be installed in a drill-through tubing spool installed between a wellhead housing and a vertical tree.

Thus, the embodiments comprise a combination of features and advantages that overcome the problems of prior art devices. The various characteristics described above, as well as other features, will be readily apparent to those skilled in the art upon reading the following detailed description of the embodiments, and by referring to the accompanying drawings.

BRIEF DESCRIPTION OF THE DRAWINGS

For a more detailed description of the embodiments, reference will now be made to the following accompanying drawings.

DETAILED DESCRIPTION OF THE EMBODIMENTS

The present invention relates to a drill-through spool body sleeve assembly and includes embodiments of different forms. The drawings and the description below disclose specific embodiments of the present invention with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results.

The drill-through spool body sleeve assembly 10 installs in the bore of a drill-through spool body. A drill-through spool body includes any body that houses the production hanger and production tubing and that may also allow the passage of equipment. A drill-through spool body thus may include a drill-through spool installed between a wellhead housing and a vertical tree. A drill-through spool body may also include a drill-through horizontal tree installed between a wellhead housing and a BOP.

Figure 1:
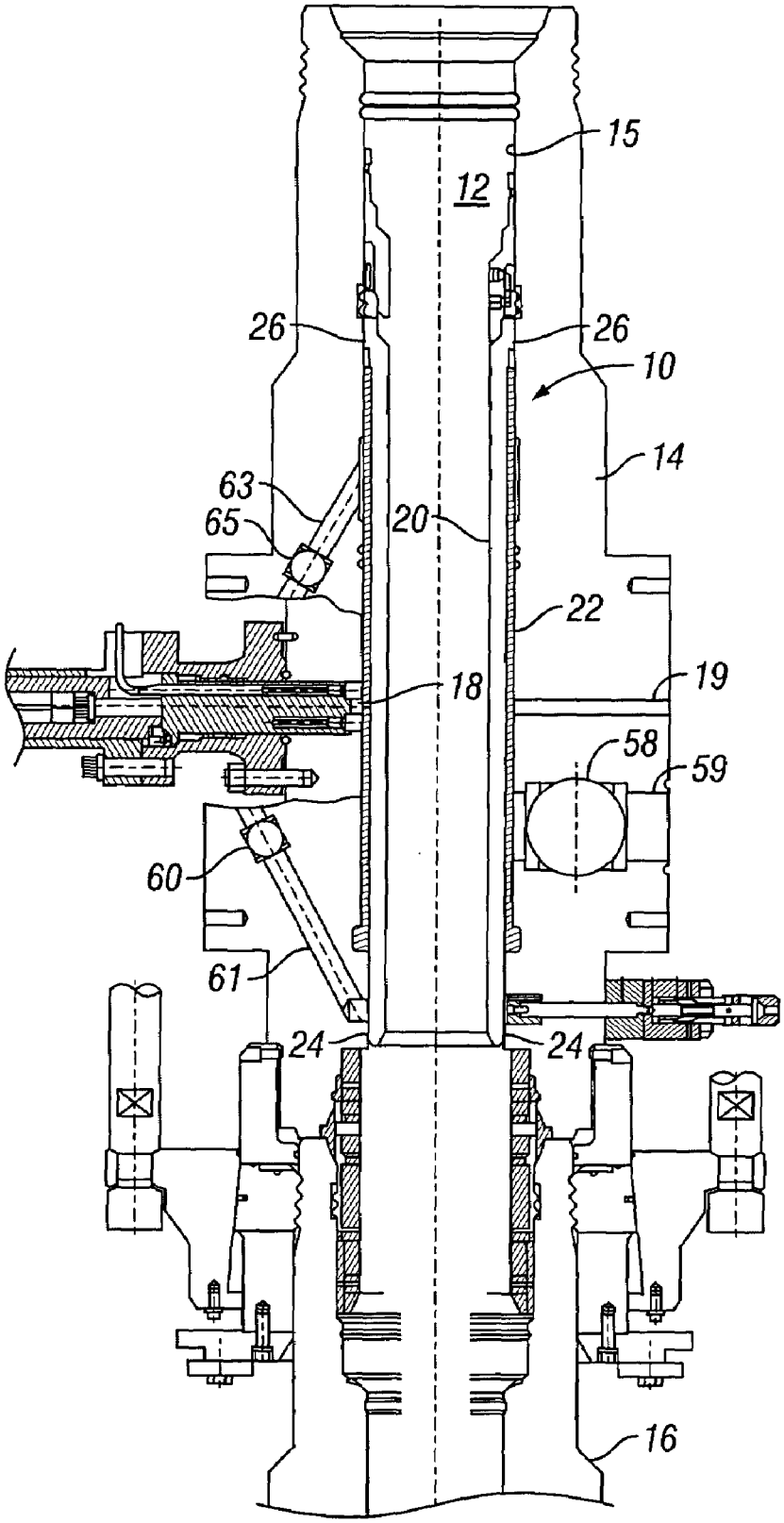
FIG. 1 is a cross section elevational view of a drill-through horizontal tree with a sleeve assembly installed.
Figure 2:
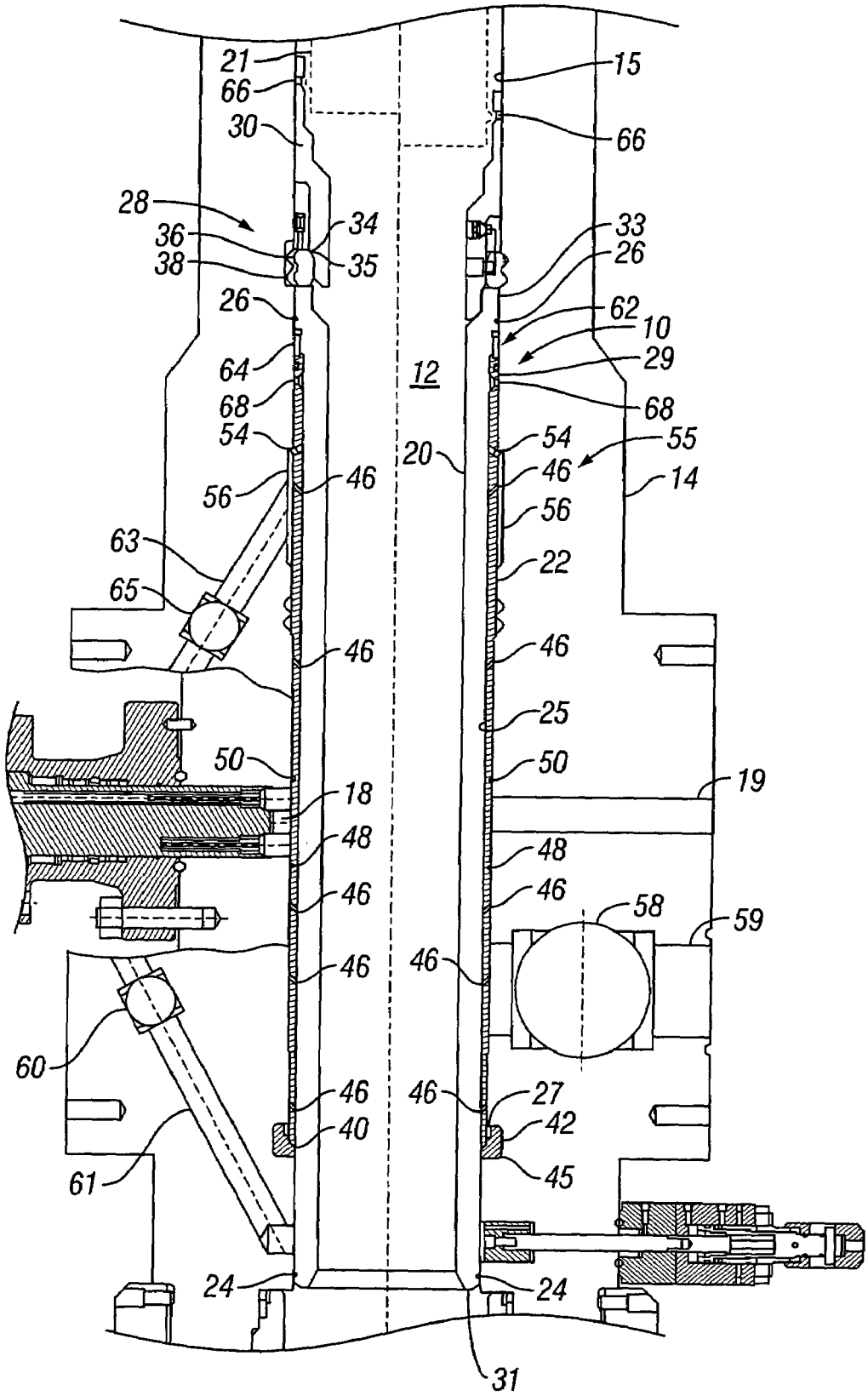
FIG. 2 is an enlarged cross sectional view of the drill-through horizontal tree of FIG. 1.

FIGS. 1–5 show how the sleeve assembly 10 is used in a horizontal drill-through tree 14. FIGS. 1 and 2 show a drill-through spool body sleeve assembly 10 installed in the through bore 12 of the tree 14. The through bore 12 forms a generally cylindrical wall 15. The lower terminal end of the tree 14 is connected and sealed to a wellhead housing 16, which in turn is connected to a conductor housing (not shown) and the well. The upper terminal end of the tree 14 is connected and sealed to a blowout preventer (BOP) (not shown). The tree 14 comprises a plurality of transverse bores opening into the through bore 12. Examples of such transverse bores include a hydraulic connection port 18, an electronic connection port 19, a lateral production outlet 59 controlled by a production valve 58, a workover port 63, and an annulus port 61, which are optionally controlled by one or more valves such as an annulus port valve 60 and workover port valve 65.

Figure 3:
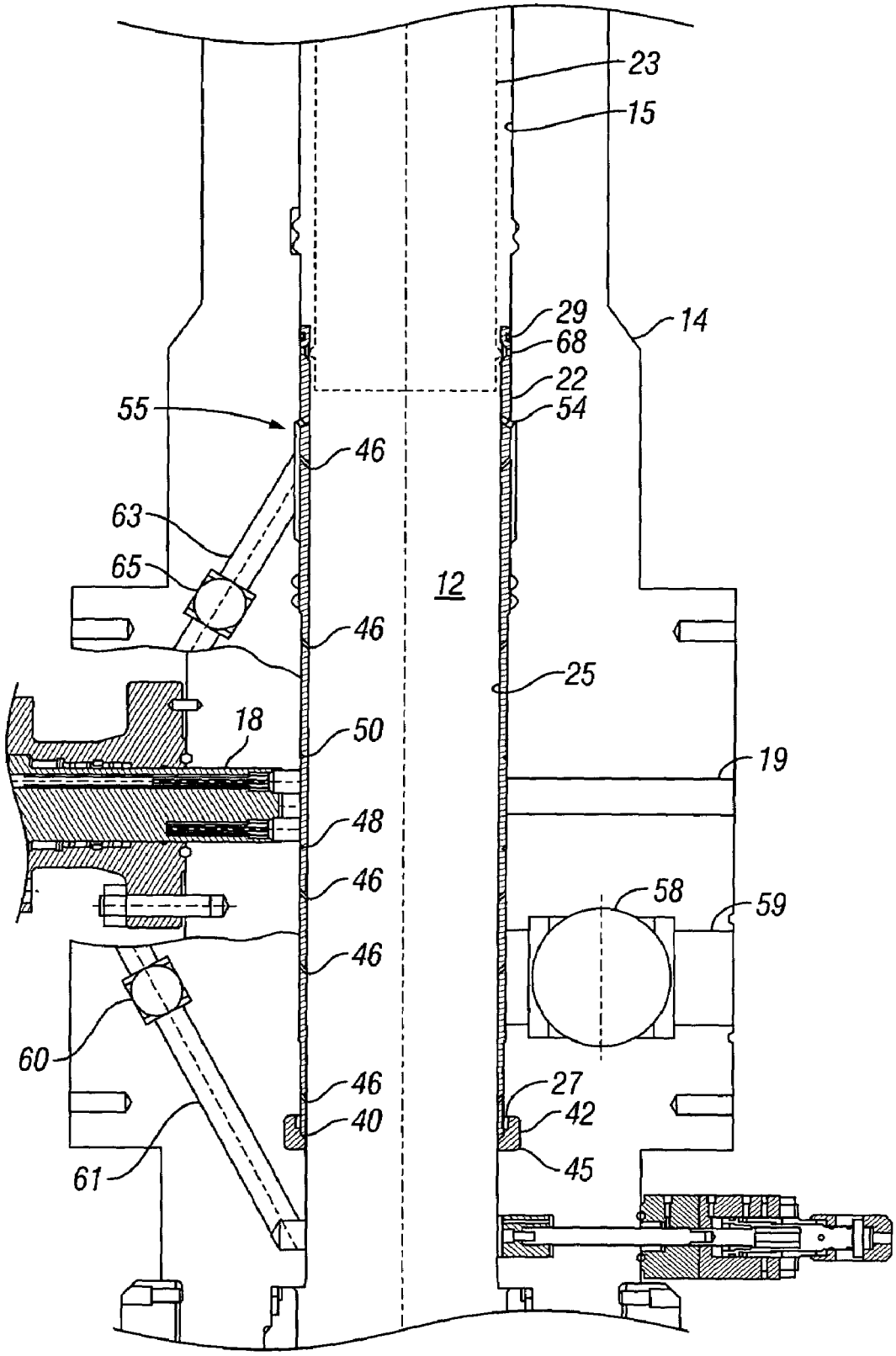
FIG. 3 is a cross sectional view of the drill-through horizontal tree with a portion of the sleeve assembly removed.

Before the tree 14 is installed on the wellhead housing 16, a wear bushing 22 comprising a lower terminal end 27 and an upper terminal end 29 is installed in the bore 12 using a wear bushing running tool 23. The wear bushing running tool 23 engages a running groove 68 in the wear bushing. The wear bushing running tool 23 installs the wear bushing 22 in the bore 12 until a wear bushing shoulder 40 on the lower terminal end 27 of the wear bushing 22 engages an annular shoulder insert 42. The annular insert 42 is disposed in an annular groove 45 in the wall 15 of the through bore 12. The wear bushing 22 also comprises ports 46 along the longitudinal length of the wear bushing 22 that extend radially through the wear bushing 22. The wear bushing 22 further comprises port seals 48, 50 that seal against the bore wall 15 above and below the hydraulic connection port 18 when the wear bushing 22 is installed. The wear bushing port seals 48, 50 also seal against the bore wall 15 above an below the electronic connection port 19. Once in position, a wear bushing locking assembly 55 then locks the wear bushing 22 into position. As best shown in FIGS. 2 and 3, the wear bushing locking assembly 55 may comprise shear pins 54 that are extended to engage a corresponding recess 56 in the bore wall 15.

After the wear bushing 22 is installed, a test sleeve 20 is inserted into the through bore 12 using a test sleeve running tool 21. The test sleeve running tool 21 engages a test sleeve running groove 66 to install the test sleeve 20. The test sleeve 20 is slidingly received through the inner diameter 25 of the wear bushing 22, with the test sleeve 20 extending past both terminal ends 27, 29 of the wear bushing 22. However, the test sleeve 20 need not extend past the ends 27, 29 of the wear bushing 22. As the test sleeve 20 is put into position, a lower test sleeve seal 24 seals against the bore wall 15 at the test sleeve lower terminal end 31. An upper test sleeve seal 26 also seals against the bore wall 15 at the test sleeve upper terminal end 33. The configuration of the test sleeve 20 and the bore wall 15 are such that the test sleeve 20 may not pass through the lower terminal end of the through bore 12. For example, the bore wall 15 and the outer diameter of the test sleeve 20 may have matching tapered profiles with a reduced diameter towards the lower terminal end of the through bore 12.

Once installed, the test sleeve 20 is then locked into position using a locking assembly 28. As best shown in FIG. 2, the locking assembly 28 may comprise a retaining collar 30 and an dogs 36 installed between a portion of the outer diameter of the retaining collar 30 and the bore wall 15. The collar 30 outer diameter comprises a shoulder 34 that engages a corresponding shoulder 35 on each dog 36. The dogs 36 are matched to engage a profile 38 in the bore wall 15. Initially, the dogs 36 are in an unengaged position shown in FIG. 2 on the left side of the upper portion of the test sleeve 20. Under an axial force on the collar 30, the collar shoulder 34 acts on and cams onto the dog shoulders 35 to expand the dogs 36. When the dogs 36 expand they move to an engaged position with the profile 38 of the bore wall 15 shown in FIG. 2 on the right side of the upper portion of the test sleeve 20. Engaged with the drill-through tree bore 12, the dogs 36 lock the test sleeve 20 in place in the tree 14.

Once the sleeve assembly 10 is installed in the tree 14, the tree transverse bores and the valves disposed in the bores may optionally be pressure tested. After testing, the lower terminal end of the tree 14 is engaged with the wellhead housing 16 as shown in FIG. 1. A BOP is then connected and sealed with the upper terminal end of the tree 14.

Once in position on the wellhead housing 16 with the BOP attached, pressure tests can be performed on the inside of the tree 14 to test the valves and connections in the transverse bores such as the hydraulic connection port 18, production outlet 59, electronic connection port 19, and the valves 58, 60, and 65. Pressure tests can also be performed against the inside of the valves 58, 60, and 65 by introducing pressure to the annulus between the test sleeve 20 and the tree bore 12. The pressure tests are performed to inspect the integrity of the seals, ports, outlets, and valves under operating pressures.

During the pressure tests, the test sleeve seals 24, 26 prevent pressure from passing between the inside of the test sleeve 20 and the hydraulic connection port 18 and electronic connection port 19. The test sleeve seals 24, 26 also prevent pressure from passing between the inside of the test sleeve 20 and the drill-through tree outlet 59 and ports 61, 63. The test sleeve 20 is of sufficient thickness to withstand the pressures of the pressure tests without deforming. During the pressure tests, the pressure placed on the inside of the test sleeve 20 does not act on the wear bushing 22 because of the test sleeve seals 24, 26. However, the pressure applied through the tree transverse bores into the annulus between the test sleeve 20 and the bore wall 15 does act on the wear bushing 22. The wear bushing ports 46 act to relieve any pressure differentials across the wear bushing 22 except across the wear bushing seals 48, 50 at the hydraulic connection port 18 and electronic connection port 19. During the pressure tests, the wear bushing seals 48, 50 can create a pressure differential across the wear bushing 22 because of the seal formed between the outside of the wear bushing 22 and the bore wall 15. The wear bushing seals 48, 50 form a seal to prevent any debris from entering the hydraulic connection port 18 and the electronic connection port 19 from between the wear bushing 22 and the drill-through tree bore 12.

In addition to the radial pressure forces acting on the sleeve assembly 10, there are also axial forces acting in the downhole direction on both the test sleeve 20 and the wear bushing 22. The axial forces are a result of pressure end loading resulting from the different diameter of the test sleeve seals 24 and 26. In some instances where the wear bushing 22 is too thin to absorb the pressure end loads, the wear bushing 22 may comprise a load sharing member 62. The load sharing member 62 would allow the dogs 36 to share the loads with the wear bushing 22. As shown in FIG. 2, the load sharing member 62 may comprise a collapsible ring 64. As shown comparing the left and right side of the upper portion of the test sleeve 20 in FIG. 2, the collapsible ring 64 allows the test sleeve 20 to move downhole relative to wear bushing 22 under the axial load of the pressure test. As the load sharing member 62 adjusts under the axial load on the test sleeve 20, the dogs 36 interact with the profile 38 to absorb any additional axial load. Thus, the load sharing member 62 works in conjunction with the locking assembly 28 to absorb the axial load placed on the test sleeve 20 and prevent the test sleeve 20 from bearing down on and deforming the wear bushing 22.

Once the pressure tests are complete and the connections, seals, transverse bores, and valves have been tested, the test sleeve 20 is removed. The test sleeve locking assembly 28 is first disengaged using the test sleeve running tool 21 to release the dogs 36 from the profile 38. The test sleeve running tool 21 also engages a running groove 66 in the test sleeve 20 for retrieval of the test sleeve 20. As the running tool 21 removes the test sleeve 20, the wear bushing locking assembly 55 maintains the wear bushing 22 in position.

After the test sleeve running tool 21 removes the test sleeve 20, the wear bushing 22 remains in the tree 14 as shown in FIG. 3. The inside diameter of the wear bushing 22 is large enough to allow the passage of equipment such as drilling and wellhead equipment through the tree bore 12. During the drilling operations, the wear bushing 22 protects the bore wall 15, the hydraulic connection port 18, the electronic connection port 19, the production outlet 59, annulus port 61, and the workover port 63. As each section of the well is drilled, a drill string with a drill bit is run through the BOP, the tree 14, and the wellhead housing 16. After the section is drilled, the drill string is removed from the well and a casing string inserted into the well and installed in the wellhead housing 16 at its upper terminal end with a casing hanger. This procedure is repeated until the well is drilled to the appropriate depth. In addition to protecting the tree bore wall 15 from the passage of drill string and casing strings through the tree 14, the wear bushing 22 also protects from the passage of any downhole tools that may be used during the drilling of the well. During the drilling operations, the wear bushing ports 46 prevent a pressure differential from forming across the wear bushing 22. Thus, the ports 46 prevent deformation of the wear bushing 22 during the drilling operations due to pressure differentials. During the drilling operations, the wear bushing seals 48, 50 also prevent debris from entering the hydraulic connection port 18 and electronic connection port 19 from between the wear bushing 22 and the tree bore 12.

Figure 4:
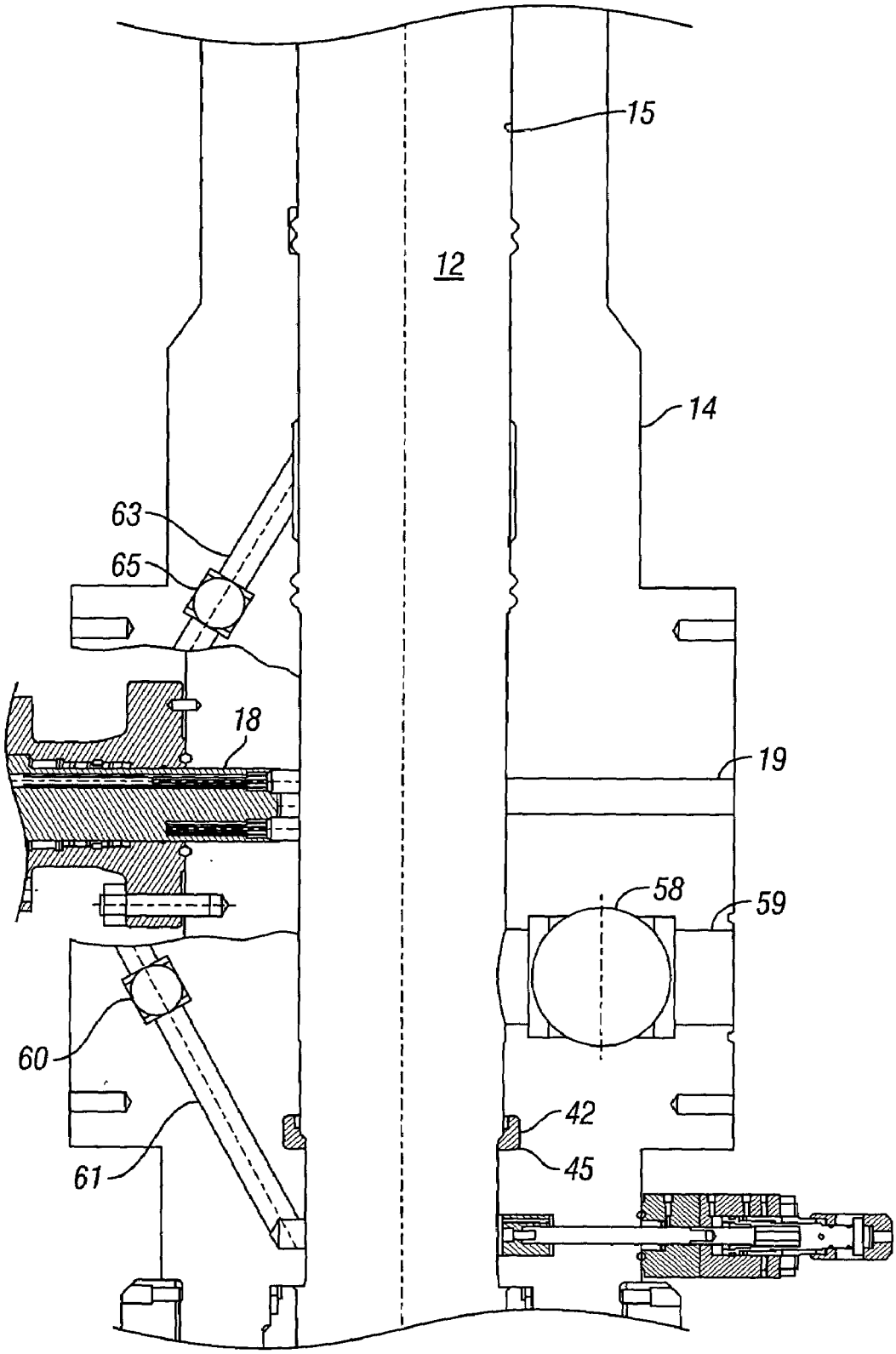
FIG. 4 is a cross sectional view of the drill-through horizontal tree with the sleeve assembly removed.

After the casing strings have been installed and the well is ready to be completed for production, the wear bushing running tool 23 is run into the tree bore 12 for engagement with the wear bushing 22. The wear bushing running tool 23 engages with a running groove 68 for removal of the wear bushing 22. Once engaged, the running tool 23 pulls the wear bushing 22 out of the tree 14 as shown in FIG. 4. After the wear bushing 22 is removed from the tree 14 as shown in FIG. 4, the well is ready for completion.

Figure 5:
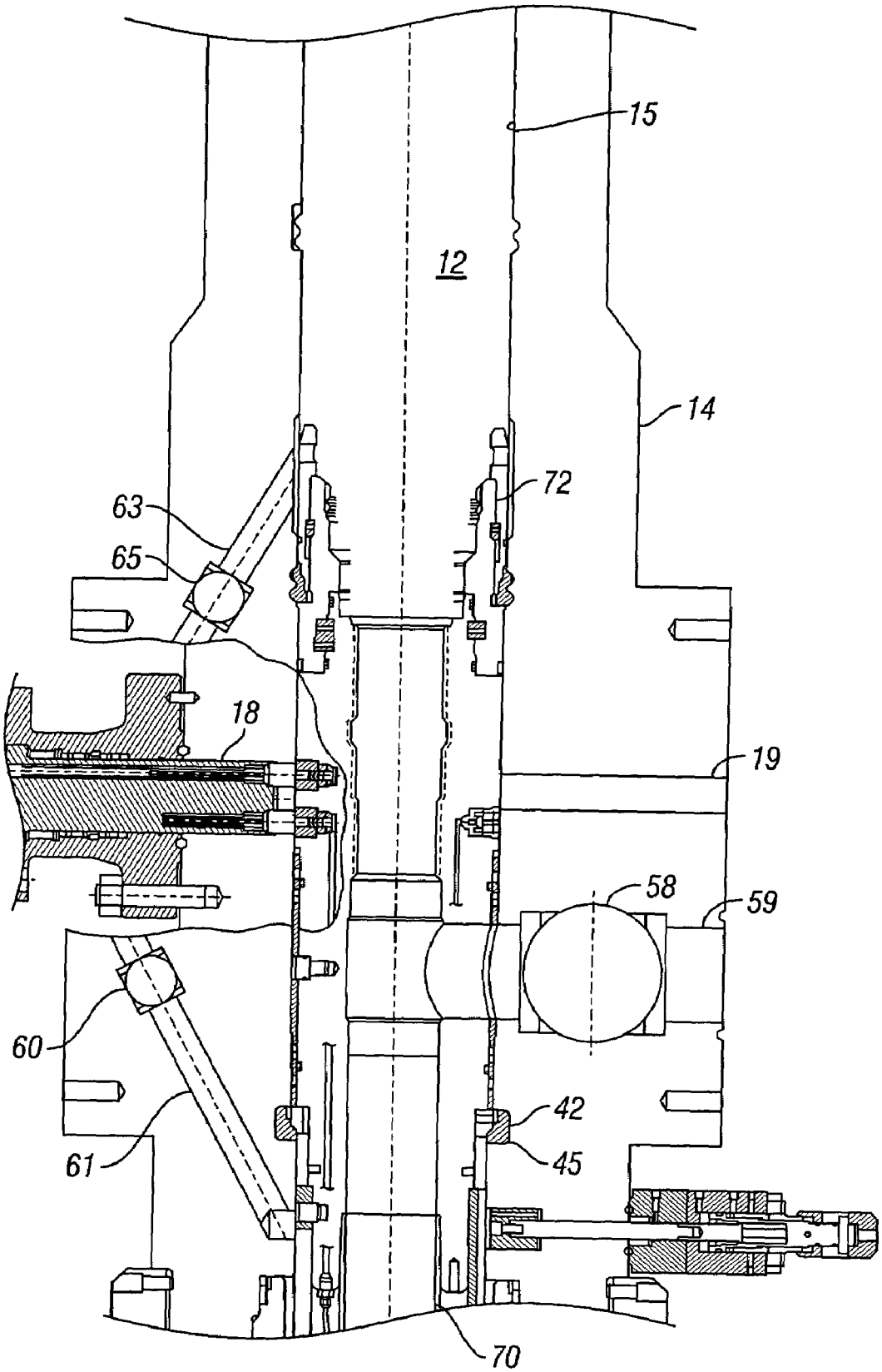
FIG. 5 is a cross sectional view of the drill-through horizontal tree with the sleeve assembly uninstalled and the production tubing and production tubing hanger installed.

As shown in FIG. 5, after the wear bushing 22 is removed from the tree 14, the production tubing 70 is inserted into the well and installed in the tree 14 with a tubing hanger 72. The production hanger 72 may now be engaged with the production port 59 for completing the well to produce well fluids.

If, during the production of the well, there arises the need to perform additional downhole work, the production tubing 70 and tubing hanger 72 may be removed from the tree 14. Once removed, the hydraulic connection port 18 and the tree bore 12 must still be protected during the additional downhole work. To this end, the wear bushing 22 may be reinserted into the tree bore 12. The wear bushing may be maintained in position by any suitable means. For example, the engagement force of the seals 48, 50 may be sufficient to maintain the wear bushing 22 in position. After the additional downhole work is complete, the wear bushing running tool 23 may again be run into the tree bore 12 to engage the wear bushing running groove 68 and then remove the wear bushing 22 from the tree 14 again. After the wear bushing 22 is removed from the tree 14, the production tubing 70 and tubing hanger 72 are again installed in the drill-through tree 14 for completing the well.

Figure 6:
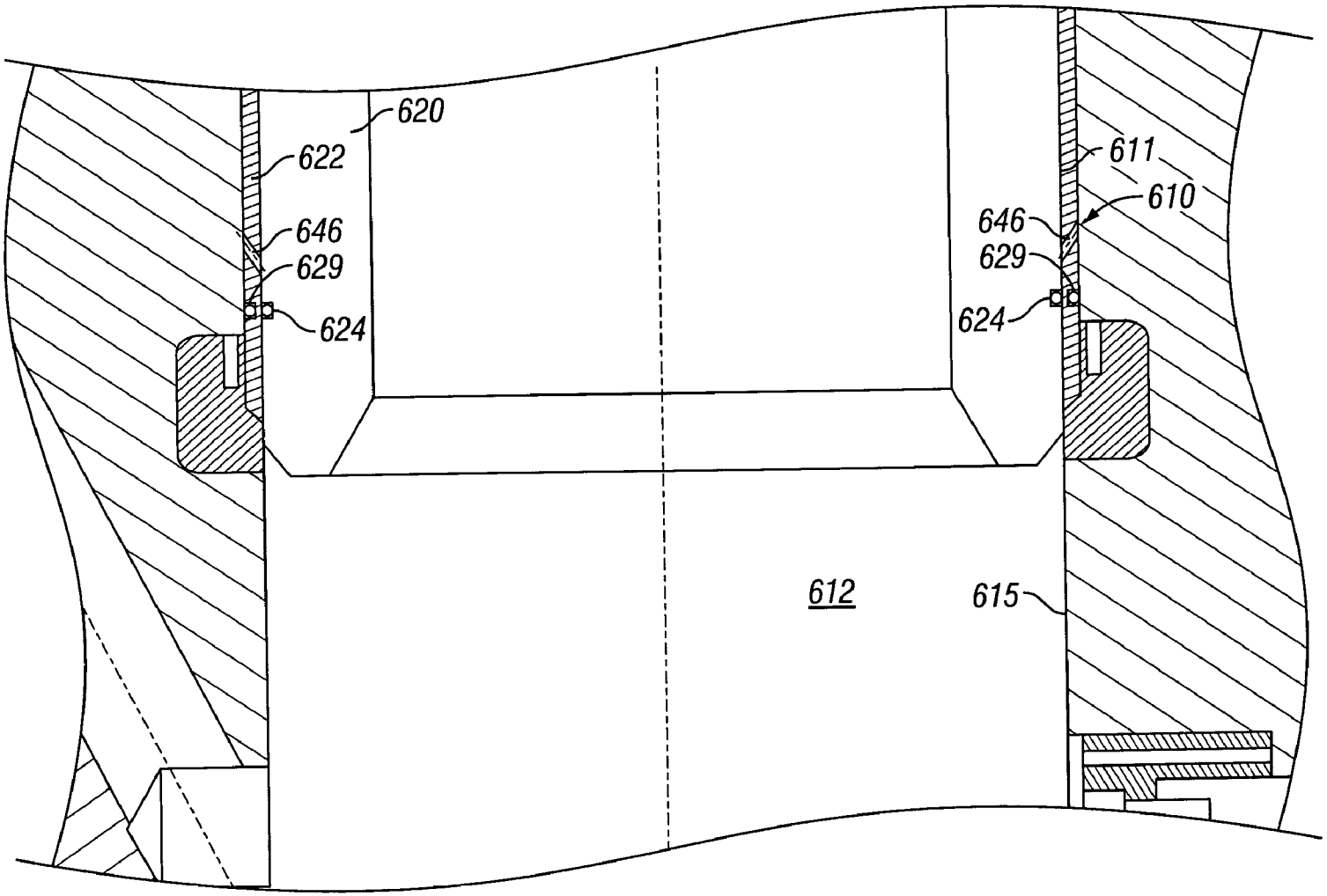
FIGS. 6 and 7 are enlarged cross sectional views of another embodiment of the sleeve assembly.
Figure 7:
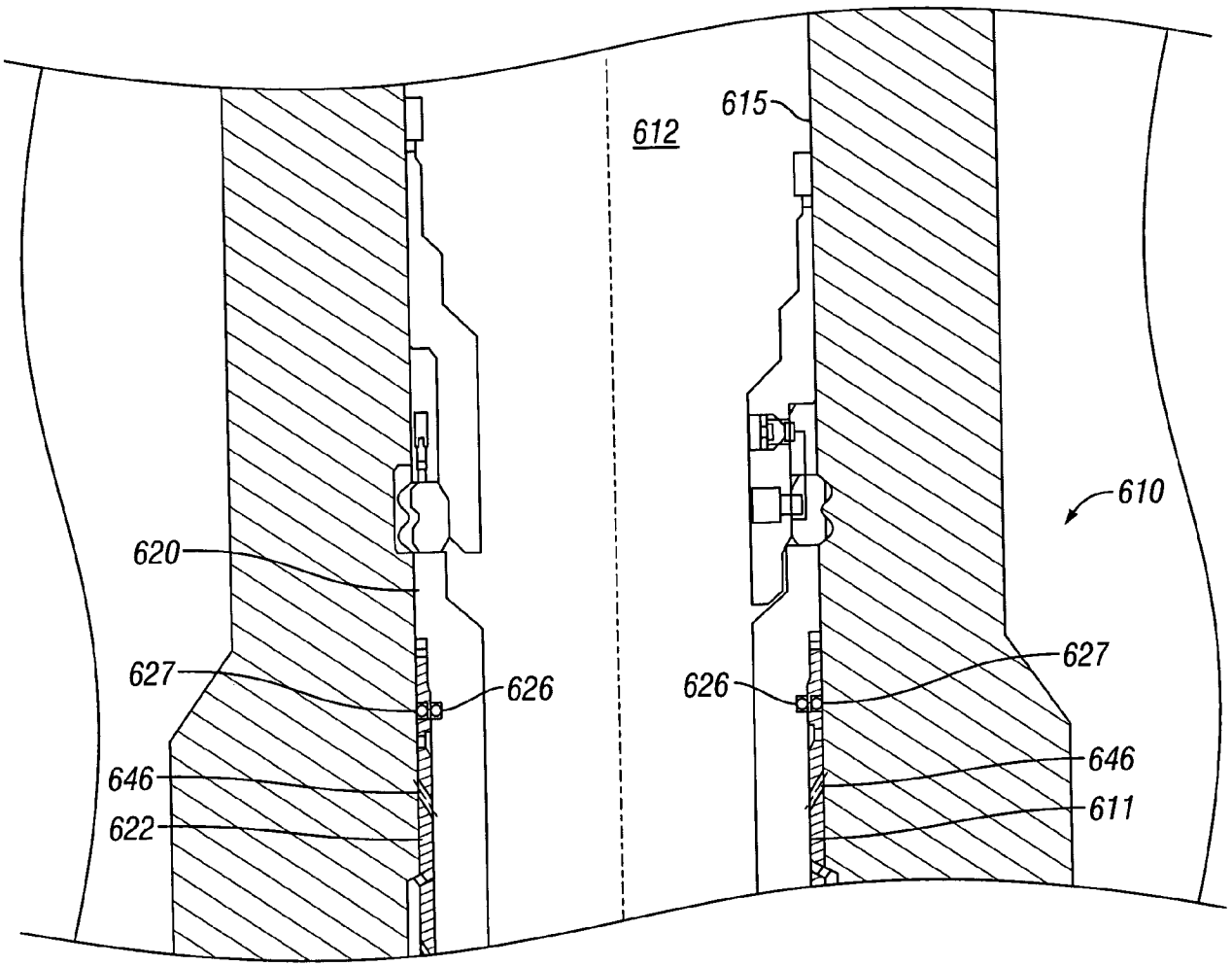

FIGS. 6 and 7 show an alternative embodiment sleeve assembly 610. The sleeve assembly operates in the same manner as the sleeve assembly 10 except as described below. In the sleeve assembly 610, the test sleeve 620 does not sealingly engage the bore wall 615 on both ends of the wear bushing 622 in the bore 612. Instead, the wear bushing 622 itself sealingly engages the bore wall 615.

To seal against the bore wall 615, the wear bushing 622 additionally comprises a lower terminal end seal 629 shown in FIG. 6 and an upper terminal end seal 627 shown in FIG. 7. The wear bushing seals 627, 629 perform the similar function of the test sleeve seals 24, 26 of the sleeve assembly 10 of preventing pressure from passing between the inside of the test sleeve 620 and the hydraulic connection port (not shown) and the electronic connection port (not shown). The wear bushing seals 627, 629 also prevent pressure from passing between the inside of the test sleeve 620 and the drill-through tree outlet (not shown) and ports (not shown). The wear bushing 622 also comprises ports 646 to relieve any pressure differentials across the wear bushing 622 due to the wear bushing seals 627, 629.

To prevent pressure from passing between the annulus 611 between the wear bushing 622 and the test sleeve 620, the test sleeve 620 sealingly engages the wear bushing 622 with a test sleeve seal 624 at its lower terminal end and a test sleeve seal 626 at its upper terminal end. The test sleeve seals 624, 626, work in conjunction with the wear bushing seals 627, 629 to prevent pressure from passing between the inside of the test sleeve 620 and the drill-through tree outlet (not shown) and ports (not shown).

Alternatively, the wear bushing 622 may only sealingly engage the bore wall 615 at either its upper terminal end or its lower terminal, instead of sealingly engaging the bore wall 615 at both ends. If one wear bushing 622 end does not sealingly engage the bore wall 615, then the test sleeve 620 may be configured similarly to the test sleeve 20 to sealingly engage the bore wall 615. In addition, the test sleeve 620 does not necessarily extend past both ends of the wear bushing 622. The test sleeve 620 may either be even with or inside the ends of the wear bushing sleeve 622.

Figure 8:
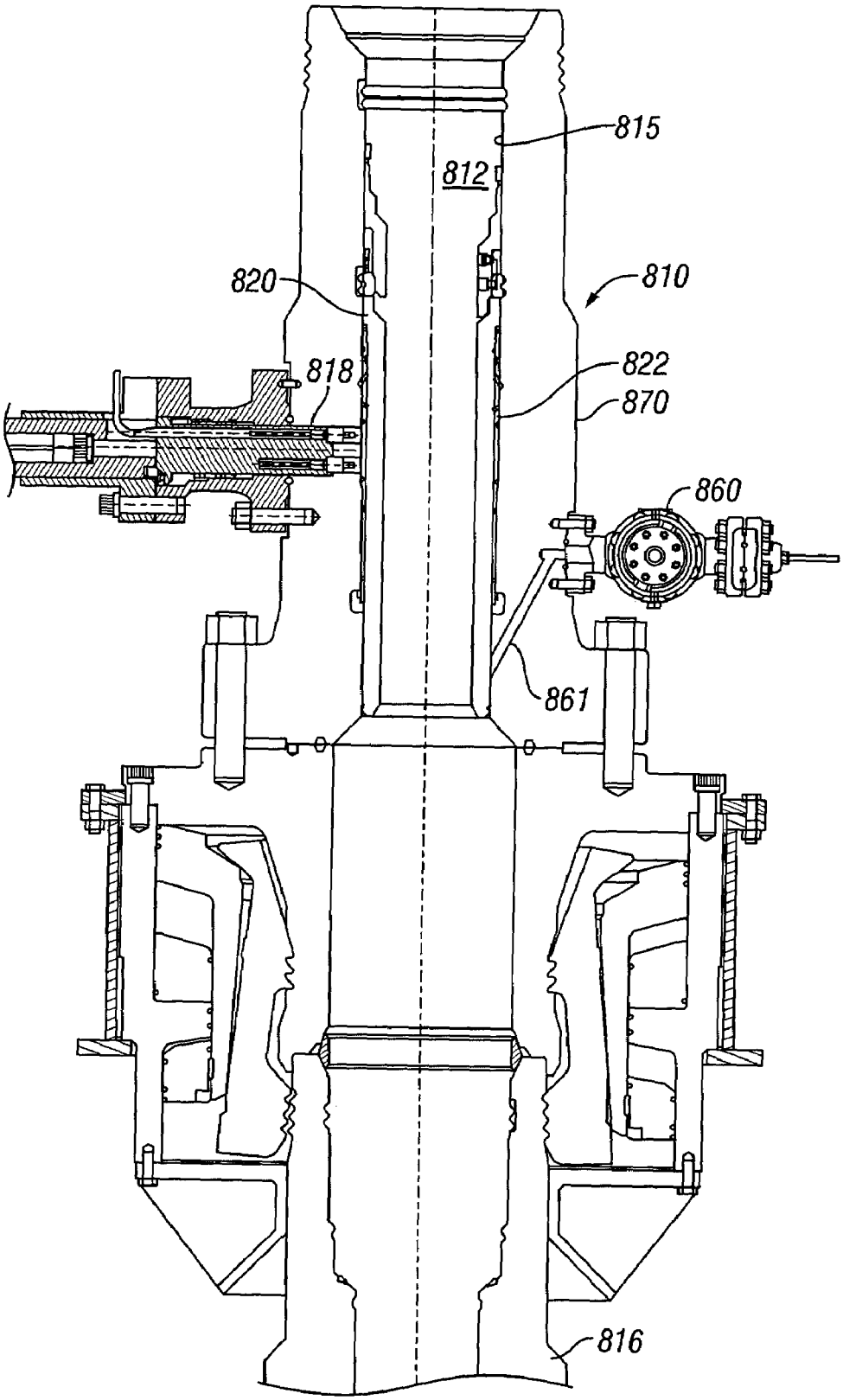
FIG. 8 is a cross sectional elevation view of a drill-through tubing spool with the sleeve assembly installed.
Figure 9:
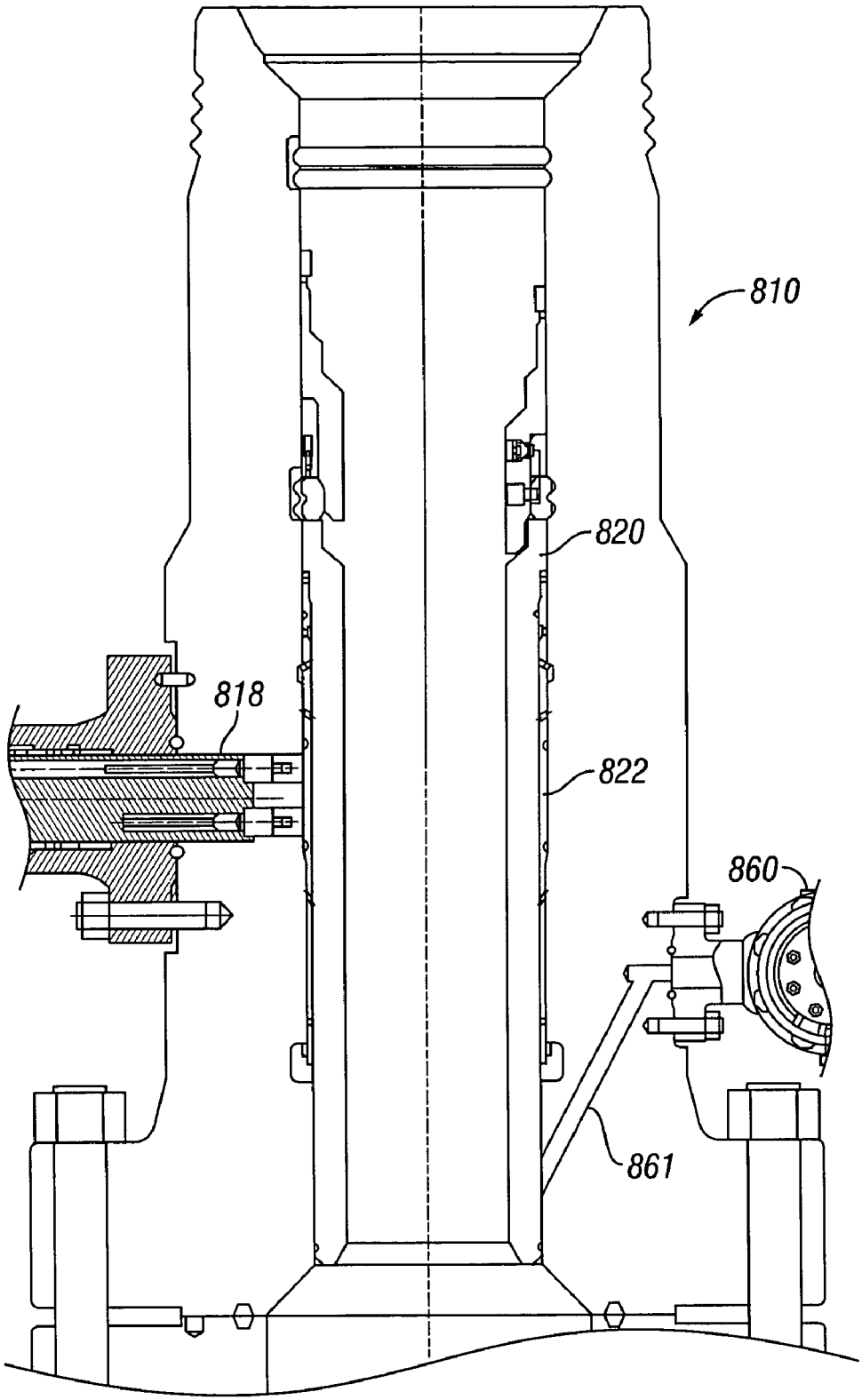
FIG. 9 is an enlarged cross sectional view of the drill-through tubing spool of FIG. 8.

As mentioned previously, the sleeve assemblies 10, 610 may be used in any drill-through spool body. Another example of a drill-through spool body is a drill-through tubing spool used with a vertical tree. FIGS. 8 and 9 show a sleeve assembly 810 as used in a drill-through tubing spool 870. The sleeve assembly 810 is installed in the through bore 812 of the tubing spool 870. The through bore 812 forms a generally cylindrical wall 815. The lower terminal end of the tubing spool 870 is connected and sealed to a wellhead housing 816, which in turn is connected to a conductor housing (not shown) and the well. The upper terminal end of the tubing spool 870 is connected and sealed to a vertical tree (not shown). The tubing spool 870 comprises a plurality of transverse bores opening into the through bore 812. Examples of such transverse bores include a hydraulic connection port 818 and an annulus port 861, which is controlled by an annulus port valve 860.

The sleeve assembly 810 comprises a wear bushing 822 and a test sleeve similar to either of the sleeve assemblies 10 or 610 described above. The sleeve assembly 810 also operates in a similar manner to either the sleeve assembly 10 or the sleeve assembly 610 described above. The only difference being the type of drill-through spool body the sleeve assembly 810 is used to test and protect.

After the sleeve assembly 810 is installed in the drill-through tubing spool 870, it may optionally be pressure tested at the surface. When ready for drilling, the drill-through tubing spool 870 is then installed on the wellhead housing 816 and a BOP (not shown) is installed on the drill-through tubing spool 870. Once installed, the,drill-through tubing spool 870 is pressure tested to verify the integrity of the transverse bores and respective valves such as the port 861 and the valve 860 as well as the hydraulics connection port 818. After the drill-through tubing spool 870 is tested, the test sleeve 820 is removed using a test sleeve running tool (not shown). The well is then drilled as described above with the drill-through spool tree 10, 610. Once the production tubing and production hanger are ready to be installed, the wear bushing 822 is removed with a wear bushing running tool (not shown). The production hanger and production tubing are then installed in the drill-through tubing spool 870. Once the production hanger and production tubing are installed, the BOP is removed from the drill-through tubing spool 870 and a vertical tree (not shown) is installed on the drill-through tubing spool 870 for producing the well fluids.

While specific embodiments have been shown and described, modifications can be made by one skilled in the art without departing from the spirit or teaching of this invention. The embodiments as described are exemplary only and are not limiting. Many variations and modifications of the system and assembly are possible and are within the scope of the invention. Accordingly, the scope of protection is not limited to the embodiments described, but is only limited by the claims that follow, the scope of which shall include all equivalents of the subject matter of the claims.

What is claimed is:

1. A sleeve assembly for a drill-through spool body having a bore having a wall, the assembly comprising:

a wear bushing removably installed in the bore;

a test sleeve removably installed within the bore and within the wear bushing;

the test sleeve allowing the drill-through spool body to be pressure tested; and the inside diameter of the wear bushing being large enough to allow the passage of equipment through the wear bushing.

2. A sleeve assembly for a drill-through spool body having a bore having a wall, the assembly comprising:

a wear bushing removably installed in the bore;

a test sleeve removably installed within the bore and within the wear bushing; and at least a portion of the outer diameter of the test sleeve sealingly engaging the bore wall.

3. The assembly of claim 2 wherein a first test sleeve terminal end sealingly engages the bore wall, a first terminal end of the wear bushing sealingly engages the bore wall, and a second terminal end of the test sleeve sealingly engages the wear bushing first terminal end.

4. The assembly of claim 3 wherein the test sleeve is removable from the spool body without removing the wear bushing from the spool body.

5. The assembly of claim 4 wherein the wear bushing protects at least a portion of the bore wall after the test sleeve is removed from the spool body.

6. The assembly of claim 5 wherein the wear bushing is removed from the spool body to complete and produce the well.

7. The assembly of claim 3 wherein the test sleeve and wear bushing sealingly engage the bore wall to allow pressure testing of spool body outlets, ports, and valves.

8. The assembly of claim 7 wherein the wear bushing further comprises ports extending between the outside and the inside of the wear bushing.

9. The assembly of claim 8 wherein the wear bushing ports prevent deformation of the wear bushing due to the pressure differentials during the pressure testing and during the drilling operations.

10. The assembly of claim 3 wherein the wear bushing comprises an interior bore that allows the passage of equipment through the wear bushing.

11. The assembly of claim 3 wherein the test sleeve interacts with the bore wall to prevent passage of the test sleeve out of the spool body in the downhole direction.

12. The assembly of claim 11 wherein a portion of the bore is of a decreased diameter to prevent passage of the test sleeve out of the lower terminal end of the spool body.

13. The assembly of claim 3 wherein the wear bushing interacts with the bore wall to prevent passage of the wear bushing out of the lower terminal end of the spool body.

14. The assembly of claim 13 wherein the lower terminal end of the wear bushing contacts a wear bushing shoulder to support the wear bushing in the spool body.

15. The assembly of claim 3 wherein the wear bushing sealingly engages the bore wall to prevent introduction of debris into at least one transverse bore through the spool body from the spool body bore.

16. The assembly of claim 3 wherein the wear bushing is connectable with a running tool for installation and removal of the wear bushing from the spool body.

17. The assembly of claim 3 wherein the test sleeve is connectable with a running tool for installation and removal of the test sleeve from the spool body.

18. The assembly of claim 3 wherein the wear bushing further comprises a wear bushing locking assembly releasably locking the wear bushing into the spool body.

19. The assembly of claim 18 wherein the wear bushing locking assembly comprises shear members for releasably retaining the wear bushing in the bore during removal of the test sleeve.

20. The assembly of claim 3 wherein the test sleeve further comprises a test sleeve locking assembly releasably locking the test sleeve into the spool body.

21. The assembly of claim 20 wherein test sleeve locking assembly comprises a collar engaged with dogs, wherein relative movement of the collar toward the test sleeve expands the dogs into engagement with a corresponding profile in the bore wall.

22. The assembly of claim 3 wherein the wear bushing further comprises a load sharing member.

23. The assembly of claim 22 wherein the load sharing member comprises a collapsible ring engaged between the wear bushing and the test sleeve, the collapsible ring designed to collapse under a designated load placed on the collapsible ring.

24. The assembly of claim 3 wherein the spool body is a drill-through tubing spool connectable to a wellhead housing and a vertical tree.

25. The assembly of claim 3 wherein the spool body is a drill-through horizontal tree connectable to a wellhead housing and a BOP.

26. A sleeve assembly for a drill-through spool body having a bore having a wall, the assembly comprising:

a wear bushing removably installed in the bore;

a test sleeve removably installed within the bore and within the wear bushing; and both the test sleeve terminal ends extending past the terminal ends of the wear bushing and sealingly engaging the bore wall.

27. The assembly of claim 26 wherein the test sleeve is removable from the spool body without removing the wear bushing from the spool body.

28. The assembly of claim 27 wherein the wear bushing protects at least a portion of the bore wall after the test sleeve is removed from the spool body.

29. The assembly of claim 28 wherein the wear bushing is removed from the spool body to complete and produce the well.

30. The assembly of claim 26 wherein the test sleeve and wear bushing sealingly engage the bore wall to allow pressure testing of spool body outlets, ports, and valves.

31. The assembly of claim 30 wherein the wear bushing further comprises ports extending between the outside and the inside of the wear bushing.

32. The assembly of claim 31 wherein the wear bushing ports prevent deformation of the wear bushing due to the pressure differentials during the pressure testing and during the drilling operations.

33. The assembly of claim 26 wherein the wear bushing comprises an interior bore that allows the passage of equipment through the wear bushing.

34. The assembly of claim 26 wherein the test sleeve interacts with the bore wall to prevent passage of the test sleeve out of the spool body in the downhole direction.

35. The assembly of claim 34 wherein a portion of the bore is of a decreased diameter to prevent passage of the test sleeve out of the lower terminal end of the spool body.

36. The assembly of claim 26 wherein the wear bushing interacts with the bore wall to prevent passage of the wear bushing out of the lower terminal end of the spool body.

37. The assembly of claim 36 wherein the lower terminal end of the wear bushing contacts a wear bushing shoulder to support the wear bushing in the spool body.

38. The assembly of claim 26 wherein the wear bushing sealingly engages the bore wall to prevent introduction of debris into at least one transverse bore through the spool body from the spool body bore.

39. The assembly of claim 26 wherein the wear bushing is connectable with a running tool for installation and removal of the wear bushing from the spool body.

40. The assembly of claim 26 wherein the test sleeve is connectable with a running tool for installation and removal of the test sleeve from the spool body.

41. The assembly of claim 26 wherein the wear bushing further comprises a wear bushing locking assembly releasably locking the wear bushing into the spool body.

42. The assembly of claim 41 wherein the wear bushing locking assembly comprises shear members for releasably retaining the wear bushing in the bore during removal of the test sleeve.

43. The assembly of claim 26 wherein the test sleeve further comprises a test sleeve locking assembly releasably locking the test sleeve into the spool body.

44. The assembly of claim 43 wherein test sleeve locking assembly comprises a collar engaged with dogs, wherein relative movement of the collar toward the test sleeve expands the dogs into engagement with a corresponding profile in the bore wall.

45. The assembly of claim 26 wherein the wear bushing further comprises a load sharing member.

46. The assembly of claim 45 wherein the load sharing member comprises a collapsible ring engaged between the wear bushing and the test sleeve, the collapsible ring designed to collapse under a designated load placed on the collapsible ring.

47. The assembly of claim 26 wherein the spool body is a drill-through tubing spool connectable to a wellhead housing and a vertical tree.

48. The assembly of claim 26 wherein the spool body is a drill-through horizontal tree connectable to a wellhead housing and a BOP.

49. A sleeve assembly for a drill-through spool body having a bore having a wall, the assembly comprising:

a wear bushing removably installed in the bore;

a test sleeve removably installed within the bore and within the wear bushing; and the terminal ends of the wear bushing sealingly engaging the bore wall and the terminal ends of the test sleeve sealingly engaging the wear bushing.

50. The assembly of claim 49 wherein the test sleeve is removable from the spool body without removing the wear bushing from the spool body.

51. The assembly of claim 50 wherein the wear bushing protects at least a portion of the bore wall after the test sleeve is removed from the spool body.

52. The assembly of claim 51 wherein the wear bushing is removed from the spool body to complete and produce the well.

53. The assembly of claim 49 wherein the test sleeve and wear bushing sealingly engage the bore wall to allow pressure testing of spool body outlets, ports, and valves.

54. The assembly of claim 53 wherein the wear bushing further comprises ports extending between the outside and the inside of the wear bushing.

55. The assembly of claim 54 wherein the wear bushing ports prevent deformation of the wear bushing due to the pressure differentials during the pressure testing and during the drilling operations.

56. The assembly of claim 49 wherein the wear bushing comprises an interior bore that allows the passage of equipment through the wear bushing.

57. The assembly of claim 49 wherein the test sleeve interacts with the bore wall to prevent passage of the test sleeve out of the spool body in the downhole direction.

58. The assembly of claim 57 wherein a portion of the bore is of a decreased diameter to prevent passage of the test sleeve out of the lower terminal end of the spool body.

59. The assembly of claim 49 wherein the wear bushing interacts with the bore wall to prevent passage of the wear bushing out of the lower terminal end of the spool body.

60. The assembly of claim 59 wherein the lower terminal end of the wear bushing contacts a wear bushing shoulder to support the wear bushing in the spool body.

61. The assembly of claim 49 wherein the wear bushing sealingly engages the bore wall to prevent introduction of debris into at least one transverse bore through the spool body from the spool body bore.

62. The assembly of claim 49 wherein the wear bushing is connectable with a running tool for installation and removal of the wear bushing from the spool body.

63. The assembly of claim 49 wherein the test sleeve is connectable with a running tool for installation and removal of the test sleeve from the spool body.

64. The assembly of claim 49 wherein the wear bushing further comprises a wear bushing locking assembly releasably locking the wear bushing into the spool body.

65. The assembly of claim 64 wherein the wear bushing locking assembly comprises shear members for releasably retaining the wear bushing in the bore during removal of the test sleeve.

66. The assembly of claim 49 wherein the test sleeve further comprises a test sleeve locking assembly releasably locking the test sleeve into the spool body.

67. The assembly of claim 66 wherein test sleeve locking assembly comprises a collar engaged with dogs, wherein relative movement of the collar toward the test sleeve expands the dogs into engagement with a corresponding profile in the bore wall.

68. The assembly of claim 49 wherein the wear bushing further comprises a load sharing member.

69. The assembly of claim 68 wherein the load sharing member comprises a collapsible ring engaged between the wear bushing and the test sleeve, the collapsible ring designed to collapse under a designated load placed on the collapsible ring.

70. The assembly of claim 49 wherein the spool body is a drill-through tubing spool connectable to a wellhead housing and a vertical tree.

71. The assembly of claim 49 wherein the spool body is a drill-through horizontal tree connectable to a wellhead housing and a BOP.

72. An assembly for a tree having transverse bores and a vertical through bore with a wall, the assembly comprising:

a first member disposed within the vertical through bore and covering at least one of the transverse bores; and a second member disposed within the vertical through bore and first member and having ends extending past the first member, the ends sealingly engaging the through bore wall and sealing off at least one of the transverse bores.

73. A method of pressure testing a drill-through spool body comprising:

removably installing a wear bushing in a bore with a wall in the spool body;

removably installing a test sleeve within the bore and within the wear bushing and with the test sleeve terminal ends sealingly engaging the bore wall to prevent pressure from passing between the inside of the test sleeve and spool body ports, outlets, and valves; and pressure testing the spool body ports, outlets, and valves.

74. A method of drilling a well bore using a drill-through spool body comprising a bore having a wall, outlets, ports, and valves, the method comprising:

removably installing a wear bushing in the bore with the outside of the wear bushing contacting the bore wall;

removably installing a test sleeve within the bore and within the wear bushing with the test sleeve terminal ends sealingly engaging the bore wall to prevent pressure from passing between the inside of the test sleeve and spool body ports, outlets, and valves;

connecting the spool body to a wellhead housing;

pressure testing the spool body outlets, ports, and valves;

removing the test sleeve from the spool body without removing the wear bushing; and protecting the bore wall and the outlets, ports, and valves during the drilling of the well bore with the wear bushing.

75. The method of claim 74 further comprising removing the wear bushing from the spool body, installing a production tubing and hanger in the spool body, and producing well fluids through the production tubing.

76. The method of claim 74 wherein the spool body is a drill-through horizontal tree and further comprising connecting the drill-through horizontal tree to a BOP.

77. The method of claim 74 wherein the spool body is a drill-through tubing spool and further comprising connecting the drill-through tubing spool to a vertical tree.

78. A method of pressure testing a drill-through spool body comprising:

removably installing a wear bushing in a bore with a wall in the spool body;

removably installing a test sleeve within the bore and within the wear bushing with a first test sleeve terminal end sealingly engaging the bore wall, a first terminal end of the wear bushing sealingly engaging the bore wall, and a second terminal end of the test sleeve sealingly engaging the wear bushing first terminal end to prevent pressure from passing between the inside of the test sleeve and spool body ports, outlets, and valves; and pressure testing the spool body ports, outlets, and valves.

79. A method of drilling a well bore using a drill-through spool body comprising a bore having a wall, outlets, ports, and valves, the method comprising:

removably installing a wear bushing in the bore with the outside of the wear bushing contacting the bore wall;

removably installing a test sleeve within the bore and within the wear bushing with a first test sleeve terminal end sealingly engaging the bore wall, a first terminal end of the wear bushing sealingly engaging the bore wall, and a second terminal end of the test sleeve sealingly engaging the wear bushing first terminal end to prevent pressure from passing between the inside of the test sleeve and spool body ports, outlets, and valves;

connecting the spool body to a wellhead housing;

pressure testing the spool body outlets, ports, and valves;

removing the test sleeve from the spool body without removing the wear bushing; and protecting the bore wall and the outlets, ports, and valves during the drilling of the well bore with the wear bushing.

80. The method of claim 79 further comprising removing the wear bushing from the spool body, installing a production tubing and hanger in the spool body, and producing well fluids through the production tubing.

81. The method of claim 79 wherein the spool body is a drill-through horizontal tree and further comprising connecting the drill-through horizontal tree to a BOP.

82. The method of claim 79 wherein the spool body is a drill-through tubing spool and further comprising connecting the drill-through tubing spool to a vertical tree.

83. A method of pressure testing a drill-through spool body comprising:

removably installing a wear bushing in a bore with a wall in the spool body;

removably installing a test sleeve within the bore and within the wear bushing with the terminal ends of the wear bushing sealingly engaging the bore wall and the terminal ends of the test sleeve sealingly engaging the wear bushing to prevent pressure from passing between the inside of the test sleeve and spool body ports, outlets, and valves; and pressure testing the spool body ports, outlets, and valves.

84. A method of drilling a well bore using a drill-through spool body comprising a bore having a wall, outlets, ports, and valves, the method comprising:

removably installing a wear bushing in the bore with the outside of the wear bushing contacting the bore wall;

removably installing a test sleeve within the bore and within the wear bushing with the terminal ends of the wear bushing sealingly engaging the bore wall and the terminal ends of the test sleeve sealingly engaging the wear bushing to prevent pressure from passing between the inside of the test sleeve and spool body ports, outlets, and valves;

connecting the spool body to a wellhead housing;

pressure testing the spool body outlets, ports, and valves;

removing the test sleeve from the spool body without removing the wear bushing; and protecting the bore wall and the outlets, ports, and valves during the drilling of the well bore with the wear bushing.

85. The method of claim 84 further comprising removing the wear bushing from the spool body, installing a production tubing and hanger in the spool body, and producing well fluids through the production tubing.

86. The method of claim 84 wherein the spool body is a drill-through horizontal tree and further comprising connecting the drill-through horizontal tree to a BOP.

87. The method of claim 84 wherein the spool body is a drill-through tubing spool and further comprising connecting the drill-through tubing spool to a vertical tree.

88. A method of testing a drill-through spool body having transverse bores and a vertical through bore with a wall, the method comprising:

covering at least one of the transverse bores with a first member;

sealing at least one of the transverse bores with a second member by sealing with the through bore wall; and pressure testing the transverse bores.

* * * * *